US011583869B2

(12) United States Patent
Kraft et al.

(10) Patent No.: US 11,583,869 B2
(45) Date of Patent: Feb. 21, 2023

(54) NOZZLE DEVICE HAVING AT LEAST TWO NOZZLE PLATES AND AT LEAST THREE OPENINGS

(71) Applicant: Dürr Systems AG, Bietigheim-Bissingen (DE)

(72) Inventors: Bernd Kraft, Steinheim-Höpfigheim (DE); Dmitri Noak, Stuttgart (DE)

(73) Assignee: Dürr Systems AG, Bietigheim-Bissingen (DE)

( * ) Notice: Subject to any disclaimer, the term of this patent is extended or adjusted under 35 U.S.C. 154(b) by 263 days.

(21) Appl. No.: 16/349,300

(22) PCT Filed: Nov. 29, 2017

(86) PCT No.: PCT/EP2017/080803
§ 371 (c)(1),
(2) Date: May 13, 2019

(87) PCT Pub. No.: WO2018/099960
PCT Pub. Date: Jun. 7, 2018

(65) Prior Publication Data

US 2020/0179956 A1 Jun. 11, 2020

(30) Foreign Application Priority Data

Nov. 30, 2016 (DE) ..... 10 2016 014 269.3

(51) Int. Cl.
*B05B 1/04* (2006.01)
*B05B 1/14* (2006.01)
(Continued)

(52) U.S. Cl.
CPC ..... *B05B 1/044* (2013.01); *B05B 1/14* (2013.01); *B05B 7/0846* (2013.01);
(Continued)

(58) Field of Classification Search
CPC ..... B05B 1/044; B05B 7/06; B05B 7/0846; B05B 1/14; B05C 5/0204;
(Continued)

(56) References Cited

U.S. PATENT DOCUMENTS 866,163 A 9/1907 Shafer
1,186,117 A * 6/1916 Moe ..... B05B 1/044 239/592
(Continued)

FOREIGN PATENT DOCUMENTS

CA 2830651 A1 10/2012
CN 1200685 A 12/1998
(Continued)

OTHER PUBLICATIONS

International Search Report and Written Opinion for PCT/EP2017/080803 dated Apr. 3, 2018 (12 pages; with English translation).
(Continued)

*Primary Examiner* — Christopher S Kim
(74) *Attorney, Agent, or Firm* — Bejin Bieneman PLC

(57) ABSTRACT

The disclosure relates to a nozzle device for emitting at least one emission medium onto a component, preferably onto a fold, an edge or a transition joint of the component. The nozzle device comprises at least two nozzle plates arranged adjoining one another, wherein a first nozzle plate comprises at least one opening for emitting at least one emission jet and a second nozzle plate comprises at least two openings for emitting at least two emission jets.

18 Claims, 11 Drawing Sheets

(51) Int. Cl.
*B05B 7/08* (2006.01)
*B05C 5/02* (2006.01)

(52) U.S. Cl.
CPC ..... *B05C 5/0204* (2013.01); *B05C 5/0216* (2013.01); *B05C 5/0254* (2013.01); *B05C 5/0279* (2013.01)

(58) Field of Classification Search
CPC ..... B05C 17/00503; B05C 17/00516; B05C 5/0216; B05C 5/0254; B05C 5/0279
USPC ..... 239/296, 299, 553.3, 553.5, 590.3, 594, 239/597, 555, 601
See application file for complete search history.

(56) References Cited

U.S. PATENT DOCUMENTS

| | | | | |
|---|---|---|---|---|
| 2,284,443 | A | 5/1942 | Paradise | |
| 3,615,054 | A * | 10/1971 | Botz | F02K 9/52 239/557 |
| 4,195,782 | A | 4/1980 | Troup | |
| 4,476,165 | A | 10/1984 | Mcintyre | |
| 4,567,934 | A | 2/1986 | Nakao et al. | |
| 4,962,891 | A * | 10/1990 | Layden | B05B 1/044 239/597 |
| 5,088,649 | A | 2/1992 | Hanson | |
| 5,145,689 | A * | 9/1992 | Allen | B29C 48/345 425/72.2 |
| 5,423,935 | A * | 6/1995 | Benecke | B05B 7/0861 156/244.11 |
| 5,472,143 | A | 12/1995 | Bartels | |
| 5,503,336 | A * | 4/1996 | Wichmann | B05B 5/0255 239/590.5 |
| 5,618,566 | A * | 4/1997 | Allen | B05C 5/0279 264/12 |
| 5,785,253 | A * | 7/1998 | Ueberschar | B05C 1/0817 118/63 |
| 5,845,846 | A | 12/1998 | Watanabe et al. | |
| 5,904,298 | A * | 5/1999 | Kwok | D01D 5/0985 239/135 |
| 5,976,249 | A | 11/1999 | Stahl | |
| 6,001,178 | A * | 12/1999 | Borgmann | B05C 5/0241 118/410 |
| 6,375,099 | B1 * | 4/2002 | McGuffey | B05C 5/027 239/553.5 |
| 6,540,831 | B1 * | 4/2003 | Craine | A61F 13/00991 118/314 |
| 6,680,021 | B1 * | 1/2004 | Kwok | B05B 7/164 264/103 |
| 7,255,292 | B2 * | 8/2007 | Saidman | B05B 7/0861 239/290 |
| 8,074,902 | B2 | 12/2011 | Burmester | |
| 9,138,753 | B1 | 9/2015 | Takahara | |
| 2003/0234303 | A1 | 12/2003 | Berning et al. | |
| 2004/0155125 | A1 | 8/2004 | Kramer et al. | |
| 2008/0145530 | A1 * | 6/2008 | Bondeson | D01D 4/025 427/207.1 |
| 2013/0011552 | A1 | 1/2013 | Bondeson et al. | |
| 2014/0367481 | A1 | 12/2014 | Toh et al. | |
| 2015/0013900 | A1 * | 1/2015 | Kwack | B29C 48/08 156/275.5 |
| 2016/0016185 | A1 * | 1/2016 | Park | G02F 1/133377 257/72 |

FOREIGN PATENT DOCUMENTS

| | | | |
|---|---|---|---|
| CN | 1859984 | A | 11/2006 |
| CN | 1305593 | C | 3/2007 |
| CN | 101918144 | A | 12/2011 |
| CN | 105263636 | A | 1/2016 |
| CN | 105772264 | A | 7/2016 |
| CN | 106140563 | A | 11/2016 |
| DE | 2048865 | B2 | 2/1973 |
| DE | 19632642 | A1 | 2/1998 |
| DE | 10 2006 012373 | B3 | 6/2007 |
| DE | 20 2010 002549 | U1 | 11/2010 |
| DE | 10 2013 217 686 | A1 | 3/2015 |
| EP | 0096453 | A2 | 12/1983 |
| EP | 1116521 | A2 | 7/2001 |
| JP | 2004283779 | A | 10/2004 |
| JP | 2015229151 | A | 12/2015 |
| WO | 2011081032 | A1 | 7/2011 |
| WO | 2012130867 | A1 | 10/2012 |

OTHER PUBLICATIONS

International Search Report and Written Opinion for PCT/EP2017/080834 dated Feb. 14, 2018 (13 pages; with English translation).
International Search Report and Written Opinion for PCT/EP2017/080821 dated Mar. 8, 2018 (15 pages; with English translation).
USPTO Non-Final Office Action for U.S. Appl. No. 16/349,301 dated Dec. 22, 2020 (41 pages).
Chinese Office Action and Search Report for CN201780074227.2 dated Sep. 30, 2020 (10 pages; English translation not available).
China National Intellectual Property Administration Office Action and Search Report for Application No. CN 201780074075.6 dated Aug. 21, 2020 (4 pages; with English translation of Search Report).
Chinese Office Action dated Sep. 1, 2020 for Patent Application No. CN201780074074.X (10 pages; with English translation).
USPTO Final Office Action dated Oct. 22, 2021 for U.S. Appl. No. 16/349,302 (19 pages).
EPO Examination Report for Application No. EP 17816557.7 dated May 25, 2021 (6 pages; with English translation).
Non-Final Office Action dated Jul. 1, 2021 for USPA No. 16349302 (55 pages).
Chinese Office Action dated Dec. 3, 2021 for related application CN201780074227.2 (22 pages; with English machine translation).
Non-Final Office Action in related U.S. Appl. No. 16/349,302 dated Mar. 7, 2022 (33 pages).

* cited by examiner

NOZZLE DEVICE HAVING AT LEAST TWO NOZZLE PLATES AND AT LEAST THREE OPENINGS

CROSS-REFERENCE TO RELATED APPLICATIONS

This application is a national stage of, and claims priority to, Patent Cooperation Treaty Application No. PCT/EP2017/080803, filed on Nov. 29, 2017, which application claims priority to German Application No. DE 10 2016 014 269.3, filed on Nov. 30, 2016, which applications are hereby incorporated herein by reference in their entireties.

BACKGROUND

The disclosure relates to a nozzle device for emitting a, for example, viscous, in particular highly viscous, emission medium onto a component, preferably for emitting the emission medium onto a fold (e.g. a standing seam), an edge or a transition joint of the component. The component is preferably a motor vehicle component (e.g. a vehicle bodywork component), although it can also be, for example, a component of a commercial vehicle (e.g. a commercial vehicle bodywork component), a component of an aircraft, a window (e.g. a window pane) or a facade component.

With regard to the general prior art, reference is made firstly to DE 10 2013 217 686 A1.

Making reference to FIG. 14, according to the prior art, in particular, standing seams (e.g. component edges) as occur for example in the door sill region or on side rails of a motor vehicle, are sealed by way of conventional, robot-guided flat jet nozzles (also known as flat stream nozzles) made of hard metal. In this method, the standing seam is sealed from at least one side and possibly also from both sides with PVC (polyvinylchloride). So that the underside of the standing seam can be sealed reliably, a robot program is usually created so that the lower edge of the spray jet delivered from the nozzle is applied a few millimetres below the standing seam and is therefore applied past ("overshooting") the standing seam. The PVC material that is applied on one side of the standing seam becomes partially applied round the seam edge and so seals the lower corrosion-susceptible side of the standing seam.

The requirements for a conventional PVC seam are typically 15 mm to 25 mm seam width and 1.5 mm to 2.5 mm seam height. So that this can be realized with a structurally limited nozzle, the slit opening of the conventional flat jet nozzle is configured convex so that the jet width of the spray jet enlarges toward the standing seam and thus toward the emission side.

A disadvantage of the prior art described above is, in particular, that, as a result of the process, a part of the PVC material is delivered "overshot" at the standing seam. This has the result that the robot guiding the flat jet nozzle and/or the application cell in which the method is carried out is soiled and therefore a greater cleaning effort is incurred. Due to the structural tolerances that are typically present in motor vehicle bodywork, the application usually cannot be set differently. The component tolerances also have the result that application to the standing seam must be made from both sides. Joined sheet metal edges differ, for example in their length, from one bodywork to the next.

An additional disadvantage of the prior art described above is the lack of flexibility. Therefore, dependent upon different quality requirements or dependent upon different configurations of the motor vehicle component to be provided with the emission medium, different nozzles must be used. However, nozzle changing processes are time-consuming and disrupt the actual application process.

DETAILED DESCRIPTION

Figure 1:
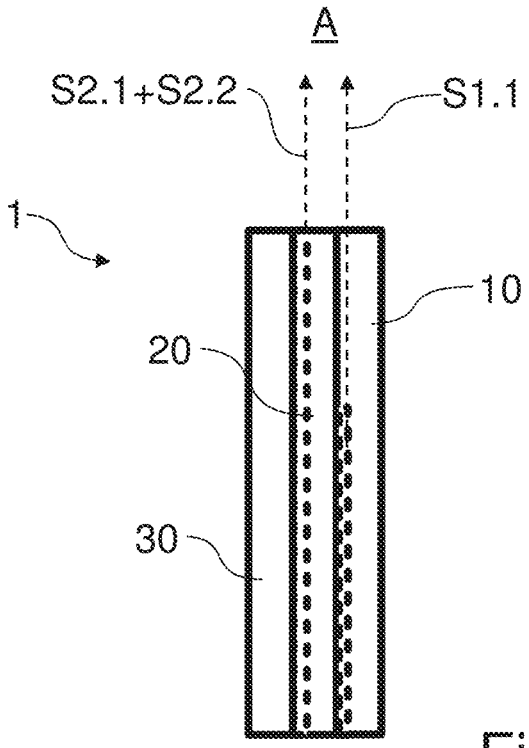
FIG. 1 shows a side view of a nozzle device according to one embodiment of the disclosure.

The disclosure relates to a nozzle device for emitting at least one emission medium onto a component, preferably onto a fold (e.g. a standing seam), an edge or a transition joint of the component.

The component is preferably a motor vehicle component, for example, a motor vehicle bodywork.

However, the component can also be a component, for example, of a commercial vehicle (e.g. a commercial vehicle bodywork component), a component of an aircraft, a window (e.g. a window pane) or a facade component.

Application fields for the nozzle device are therefore, in particular: motor vehicles, commercial vehicles, aircraft, windows and/or facade construction.

The nozzle device comprises at least two, preferably at least three nozzle plates arranged adjoining one another, in particular nozzle plates arranged substantially parallel beside one another.

A first nozzle plate has at least one opening for emitting at least one emission jet and a second nozzle plate comprises at least two openings for emitting at least two emission jets. Thus, for example, a nozzle plate with at least three openings is also possible.

In that the nozzle device may have at least three openings, different quality requirements can be fulfilled with one and the same nozzle device and/or different configurations of the component to be provided with the emission medium can be processed, specifically without a nozzle change. Thus, for example, the jet from the first nozzle plate can be used for a particular purpose, wherein the jets from the second nozzle plate can be used for another purpose. Alternatively or additionally, depending upon the purpose, the jet from the first nozzle plate and the jets from the second nozzle plate can also be output, for example, simultaneously.

It is possible that the at least one emission jet from the first nozzle plate defines a jet width and the first nozzle plate comprises an opening configuration for forming the at least one opening and the opening configuration is formed concave, in particular concavely bent, in order to bring about a narrowing of the jet width toward the emission side.

The jet width can have, for example, a single emission jet if the opening configuration comprises only a single opening for dispensing a single emission jet.

The jet width can encompass, for example, at least two emission jets if the opening configuration comprises at least two openings for emitting at least two emission jets. The at least two emission jets can define a jet width encompassing the at least two emission jets, so that a narrowing of the jet width encompassing the at least two emission jets toward the emission side can be brought about.

It is possible that the at least two openings of the second nozzle plate are oriented inwardly so that the at least two emission jets of the second nozzle plate converge to one another toward the emission side. The two emission jets can form a tapering angle, for example, of greater than 5°, greater than 10°, greater than 15°, greater than 90°, greater than 95° or greater than 100° and less than 180°.

Through the provision of a plurality of openings and preferably the narrowing of the jet width and/or the mutually converging emission jets, for example, one or more of the following advantages can be achieved:

the consumption of emission medium can be reduced.

the soiling of an application cell can be reduced.

a reliable sealing of different fold types, in particular standing seams, can be enabled.

a component measuring system for measuring the (motor vehicle) component can be dispensed with.

a high application speed can be achieved, in particular as compared with application methods with component measurement.

a larger spraying distance between the nozzle device and the (motor vehicle) component can be enabled, e.g. up to 50 mm.

larger component tolerances can be enabled, for example +/−3 mm to 5 mm.

due to the simple construction of the nozzle device, preferably there is no additional interfering outline at the applicator and/or at the robot, so that for example, even difficult to access sites such as folds, seams, edges, etc. can be readily reached.

by increasing the outflow rate of the emission medium, the application of a conventional seam, for example, made of PVC onto the (motor vehicle) component can also be enabled.

The nozzle device is suitable in particular for at least one of the following application possibilities:

sealing, for example, metallic (motor vehicle) components which are welded or glued, e.g. folds (in particular standing seams) or transition joints, but also, for example, component edges of individual components.

for example, 3-sided encompassing (enclosing) application (coating) of a, for example, viscous or highly viscous emission medium onto a (motor vehicle) component, for corrosion protection of cut edges on, for example, metal sheets, protection against injury during manual component handling (e.g. with sharp-edged metal sheets), protection against edge damage (e.g. with fibre composite materials) and/or abrasion resistance.

It is possible that the first nozzle plate comprises an entry opening for an emission medium and the second nozzle plate comprises an entry opening for an emission medium and the entry opening of the first nozzle plate and the entry opening of the second nozzle plate are spatially separated from one another.

It is possible that the nozzle device comprises a feed channel for the emission medium, by means of which the emission medium is feedable to the at least one opening of the first nozzle plate and also to the at least two openings of the second nozzle plate. Thus, the at least one opening of the first nozzle plate and the at least two openings of the second nozzle plate are suitably bringable into fluidic connection with the same feed channel in order preferably to apply the same emission medium.

It is possible that the nozzle device comprises at least one suitably drivable valve (e.g. a needle valve) and that the valve is configured for optional activation and/or deactivation of an emission of an emission medium from the at least one opening of the first nozzle plate and/or an emission of an emission medium from the at least two openings of the second nozzle plate.

The nozzle device can comprise, for example, a bottom component (preferably a base component) for the at least two nozzle plates and, for example a first feed portion for feeding the emission medium to the first nozzle plate and a second feed portion for feeding the emission medium to the second nozzle plate can be arranged in the bottom component. The first feed portion suitably serves for feeding the emission medium to the at least one opening of the first nozzle plate. The second feed portion suitably serves for feeding the emission medium to the at least two openings of the second nozzle plate.

The bottom component can be arranged, dependent upon the application, for example, above, below and/or laterally beside the at least two nozzle plates.

The first feed portion and the second feed portion can preferably be supplied with emission medium through the feed channel.

It is possible that the valve serves for the optional opening and/or closing of the first feed portion and/or the second feed portion and for this purpose can extend, for example, into the first feed portion and/or the second feed portion.

The valve can preferably be accommodated at least in sections in the bottom component.

It is possible that the nozzle device comprises a plate holder for holding the at least two nozzle plates and/or for accommodating the bottom component.

The plate holder can comprise, for example, two clamping parts (e.g. clamping plates).

The plate holder and/or the bottom component can be, for example, part of an application head on which preferably a plurality of nozzle arrangements oriented in different spatial directions are arranged, of which at least one can be configured as a nozzle device as disclosed herein. The application head is typically also designated, for example, a 3-D (application) head or a 3-D gun.

It is possible that the valve is accommodated at least in sections in the plate holder, for example, in a clamping part of the plate holder.

The at least one opening of the first nozzle plate can be configured, for example, as a slit opening for emitting a flat jet. Alternatively or additionally, the at least two openings of the second nozzle plate can be configured as slit openings for the emission of two flat jets.

It is possible that the at least two openings of the second nozzle plate are oriented in the same plane or are oriented at least parallel to one another.

It is possible that, firstly, the at least one opening of the first nozzle plate and, secondly, the at least two openings of the second nozzle plate are arranged mutually offset in the transverse direction of the first nozzle plate and the second nozzle plate, but are preferably oriented in substantially parallel planes.

It is possible that the first nozzle plate comprises a horn structure protruding on two sides with two inwardly formed inner flanks in order to deflect inwardly the emission medium issued from the at least one opening of the first nozzle plate. Alternatively or additionally, the second nozzle plate can comprise a horn structure protruding on two sides with two inwardly formed inner flanks in order to deflect inwardly the emission medium issued from the at least two openings of the second nozzle plate.

The nozzle device can comprise at least three or even at least four nozzle plates.

A third nozzle plate can serve, for example, to close the at least one opening of the first nozzle plate and/or the at least two openings of the second nozzle plate in the peripheral direction.

The first nozzle plate can be used, for example, to close the at least two openings of the second nozzle plate in the peripheral direction. Alternatively or additionally, the second nozzle plate can be used, for example, to close the at least one opening of the first nozzle plate in the peripheral direction.

It is possible that at least two of the following nozzle plates are configured on the output side complementary to one another at least in sections, in order for example to end substantially flush with one another: the first nozzle plate, the second nozzle plate and/or the third nozzle plate.

The third nozzle plate can be a blind plate, suitably without its own material channel incorporated for feeding emission medium. It is possible that the nozzle device comprises one or a plurality of such nozzle plates preferably configured as blind plates.

The emission medium can be a gas and/or a viscous, in particular a highly viscous, emission medium (e.g. PVC: polyvinylchloride). In the field of automotive painting, sealing and gluing high viscosity is considered to be above about 1 Pas, with sealing application considered to have a maximum of about 10 Pas and gluing applications to have a maximum of about 2500 Pas.

The opening width of the at least one opening of the first nozzle plate and/or the at least two openings of the second nozzle plate can be, for example, a value of between 0.2 mm and 0.5 mm.

The first nozzle plate comprises, for example, only a single opening. However, the first nozzle plate can also comprise a plurality of openings and can be configured, for example, like the second nozzle plate.

The disclosure made regarding the second nozzle plate can suitably also apply for the first nozzle plate and vice versa, so that the first nozzle plate can suitably be configured, for example, like the second nozzle plate and vice versa.

The application medium can comprise, for example, PVC (polyvinylchloride) and/or a PVC plastisol.

The features "concave" and "concavely bent" in the context of the disclosure preferably substantially comprise arched concave configurations, although they are not restricted thereto, but can also comprise, for example, linear concave configurations.

The examples of the disclosure described making reference to the drawings partially match one another, so that similar or identical parts are provided with the same reference signs and for their explanation, reference is also made, for the avoidance of repetition, to the description of other examples or figures.

Figure 2:
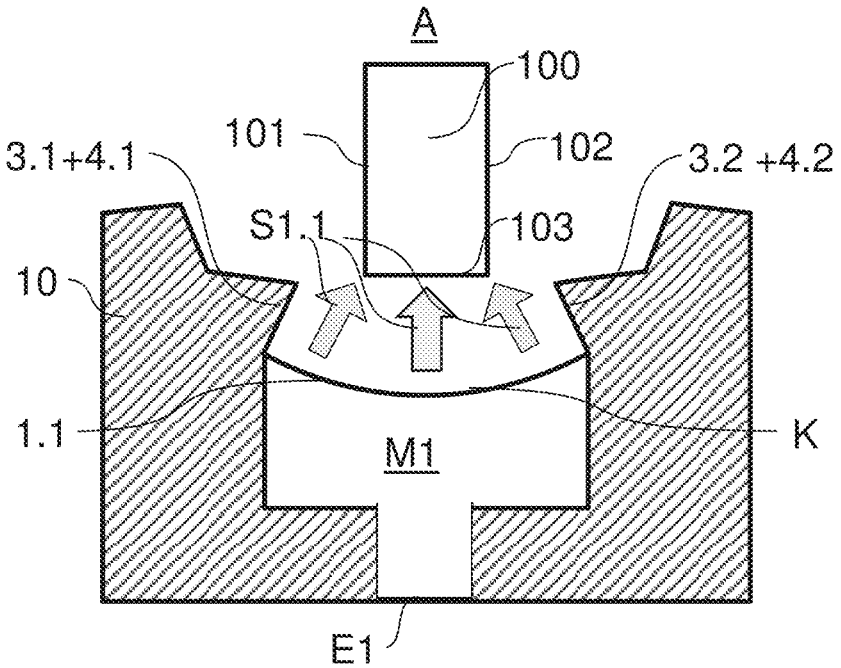
FIG. 2 shows a sectional view of the first nozzle plate shown in FIG. 1.
Figure 3:
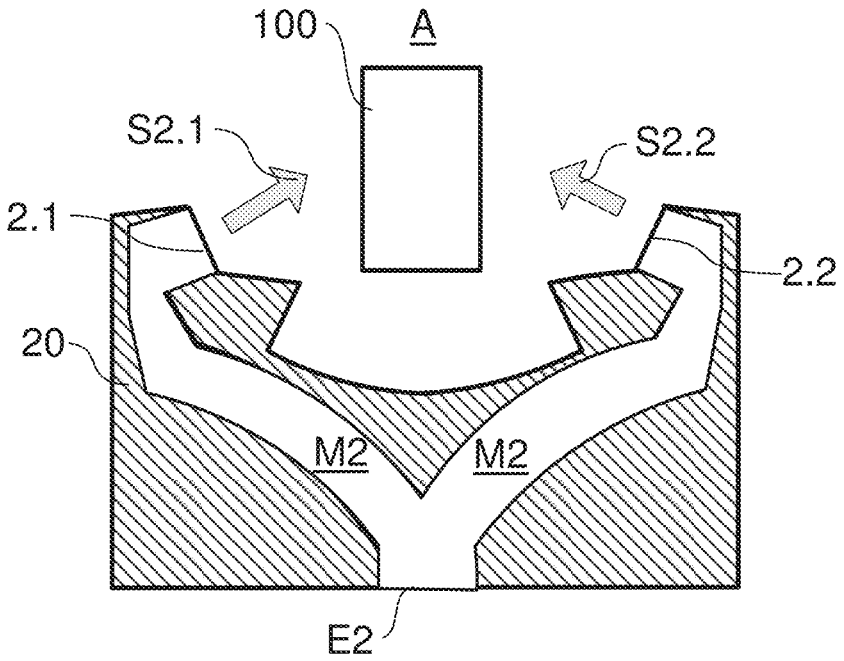
FIG. 3 shows a sectional view of the second nozzle plate shown in FIG. 1.
Figure 4:
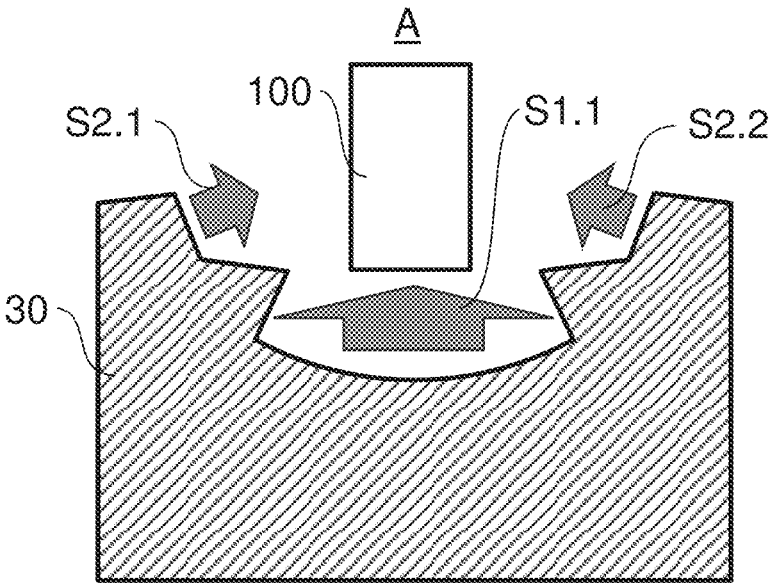
FIG. 4 shows a sectional view of the third nozzle plate of FIG. 1 and illustrates an application process realizable with the nozzle device.

FIG. 1 shows a side view of a nozzle device 1 with three nozzle plates 10, 20, 30, whist FIG. 2 shows a sectional view of the nozzle plate 10, FIG. 3 shows a sectional view of the nozzle plate 20 and FIG. 4 shows a sectional view of the nozzle plate 30.

The nozzle device 1 will now be described making reference jointly to FIGS. 1 to 4.

The nozzle device 1 serves to emit a viscous emission medium onto a component 100, e.g. a motor vehicle component 100, preferably a fold, an edge or a transition joint of the motor vehicle component 100.

The nozzle device 1 comprises three nozzle plates 10, 20, 30 arranged substantially parallel adjoining one another.

The first nozzle plate 10 comprises an opening 1.1 configured as a slit opening for emitting an emission jet S1.1 in the form of a flat jet and an entry opening E1 for the emission medium, so that the emission medium can be fed to the opening 1.1.

The second nozzle plate 20 comprises two openings 2.1, 2.2 (as shown or concave or convex) configured as slit openings for emitting two flat jets S2.1, S2.2 and an entry opening E2 spatially separated from the entry opening E1 for the emission medium, so that the emission medium can be fed to the two openings 2.1, 2.2.

Figure 5:
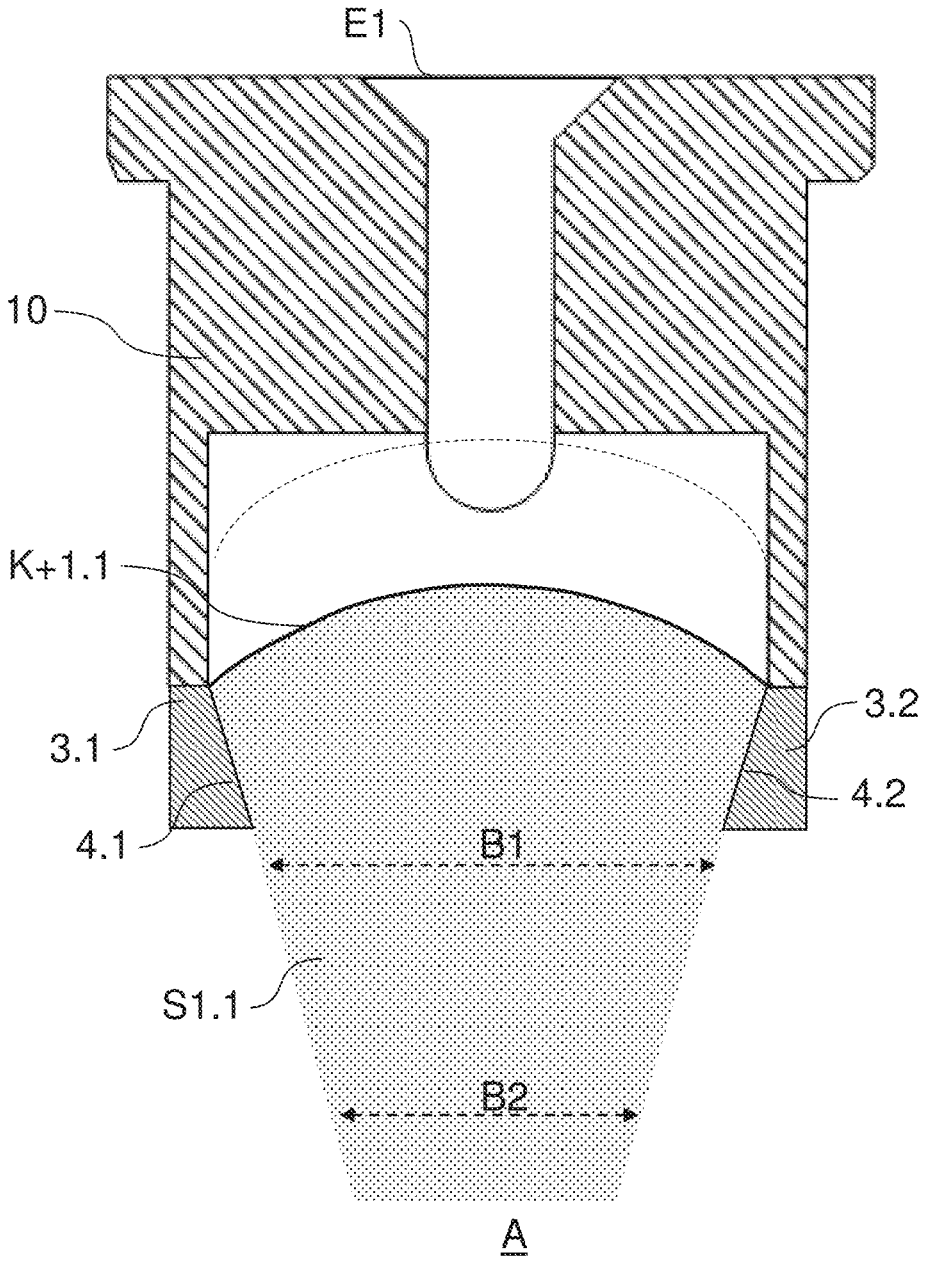
FIG. 5 shows a sectional view of a nozzle plate according to another example of the disclosure.

The flat jet S1.1 from the first nozzle plate 10 defines, similarly to that shown in FIG. 5, a jet width. An opening configuration K for forming the opening 1.1 is suitably formed concavely bent in order to bring about a narrowing of the jet width toward the emission side A.

The two openings 2.1, 2.2 of the second nozzle plate 20 are oriented inwardly so that the two emission jets S2.1, S2.2 of the second nozzle plate 20 converge to one another toward the emission side A.

The second nozzle plate 20, specifically the rear side thereof, is used to close the opening 1.1 and a material feed M1 incorporated into the first nozzle plate 10 for the emission medium, in the peripheral direction.

A third nozzle plate 30 is used to close the openings 2.1, 2.2 and a material feed M2 for the emission medium incorporated into the second nozzle plate 20, in the peripheral direction.

A comparison of FIGS. 1 to 4 shows that the first nozzle plate 10, the second nozzle plate 20 and the third nozzle plate 30 are formed to be complementary in sections on the output side.

Arranged on both sides externally adjoining the opening 1.1 is a protruding horn structure 3.1, 3.2. The horn structure 3.1, 3.2 comprises two inwardly formed inner flanks 4.1, 4.2. The inner flanks 4.1, 4.2 are configured to act upon the emission jet S1.1 output from the opening 1.1, so that it is deflectable inwardly. The horn structure 3.1, 3.2 is optional. The emission jet S1.1 narrows due to the suitably concavely bent opening configuration K, even without the optional horn structure 3.1, 3.2.

During the emission of the emission medium, the nozzle device 1 and the motor vehicle component 100, in particular for example a fold, an edge or a transition joint of the motor vehicle component 100 can be substantially oriented at the end side toward one another.

The jet S1.1 from the nozzle plate 10 can be used, despite the substantially end-sided orientation due to its jet width narrowing, for application purposes in which both side surfaces 101, 102 and the end surface 103 of the vehicle component 100 are to have the emission medium applied to them.

The jets S2.1, S2.2 from the second nozzle plate 20 can be used, despite the substantially end-sided orientation due to their inward orientation, for application purposes in which, in particular, the side surfaces 101, 102 are to have the emission medium applied to them.

Dependent upon the application case and preferably in a valve-controlled manner, the emission medium can be output from the opening 1.1, whilst an emission of the emission medium from the two openings 2.1, 2.2 does not take place.

The nozzle device 1 can comprise one or more valves (not shown in FIGS. 1 to 4).

Dependent upon the application case and preferably in a valve-controlled manner, the emission medium can be output from the two openings 2.1, 2.2 whilst an emission of the emission medium from the opening 1.1 does not take place.

Dependent upon the application case and preferably in a valve-controlled manner, the emission medium can be output from the two openings 2.1, 2.2 and simultaneously from the opening 1.1.

FIG. 5 shows a sectional view of a nozzle plate 10 according to another example of the disclosure.

The jet S1.1 is a flat jet and defines a jet width B1, B2.

An opening configuration K for forming the opening 1.1 is suitably formed concavely bent in order to bring about a narrowing of the jet width B1, B2 toward the emission side A.

The nozzle plate 10 also comprises an optional horn structure 3.1, 3.2 with two inwardly formed inner flanks 4.1, 4.2. The inner flanks 4.1, 4.2 are configured to act upon the emission jet S1.1, so that it is deflectable inwardly. The horn structure 3.1, 3.2 is optional. The emission jet S1.1 narrows due to the concave opening configuration K, even without the optional horn structure 3.1, 3.2.

Figure 6:
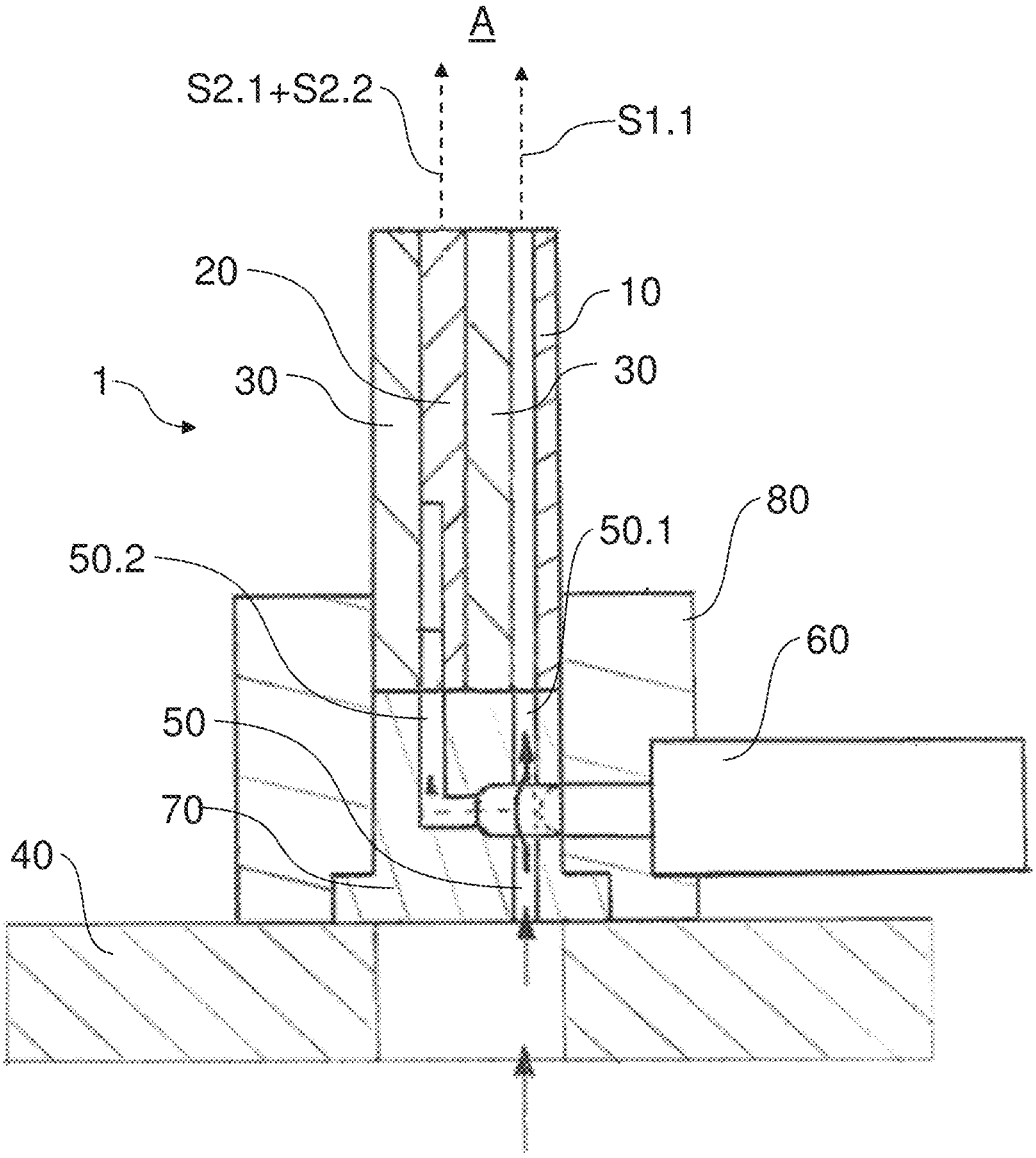
FIG. 6 shows a sectional view of a nozzle device according to one example of the disclosure.

FIG. 6 shows a sectional view of a nozzle device 1 according to one example of the disclosure with four nozzle plates, specifically a first nozzle plate 10, a second nozzle plate 20 and two third nozzle plates 30.

The nozzle device 1 is mounted on an application head 40 which is shown only schematically. The application head 40 preferably comprises three nozzle arrangements arranged in different directions, of which at least one is a nozzle device 1 configured as shown in FIG. 6.

The nozzle device 1 comprises a feed channel 50 for the emission medium, so that the emission medium is feedable to the first nozzle plate 10 and the second nozzle plate 20, so that the first nozzle plate 10 and the second nozzle plate 20 can be supplied with the emission medium from the same feed channel 50.

A valve 60, preferably a needle valve, serves for optional activation or deactivation of an emission of an emission medium from the two openings 2.1, 2.2 of the second nozzle plate 20, whereas preferably, an optional deactivation of the emission of the emission medium from the opening 1.1 through the valve 60 is not provided, but dependent upon the application case, is possible.

The nozzle device 1 comprises a bottom component 70 for the four nozzle plates 10, 20, 30. The bottom component 70 suitably serves as the base for the nozzle plates 10, 20, 30 and can thus also be designated the base part 70.

The bottom component 70 comprises the feed channel 50.

The bottom component 70 comprises a first feed portion 50.1 for feeding the emission medium to the first nozzle plate 10, in particular to the entry opening E1.

The bottom component 70 further comprises a second feed portion 50.2 for feeding the emission medium to the second nozzle plate 20, in particular to the entry opening E2.

The first feed portion 50.1 and the second feed portion 50.2 are suppliable with the emission medium by way of the feed channel 50.

The valve 60 suitably serves for the optional opening or closing of the second feed portion 50.2. However, examples are also possible in which the valve 60 serves for the optional opening or closing of the first feed portion 50.1 and/or of the second feed portion 50.2. Examples with a plurality of valves are also possible.

A plate holder 80 comprising, for example, two clamping parts serves for holding the four nozzle plates 10, 20, 30 and simultaneously also for receiving the bottom component 70.

The valve 60 is received in sections in the bottom component 70 and in sections in the plate holder 80.

The valve 60, the bottom 70 and/or the plate holder 80 can be mounted externally on the application head 40, but can also be accommodated at least partially in the application head 40.

Figure 7:
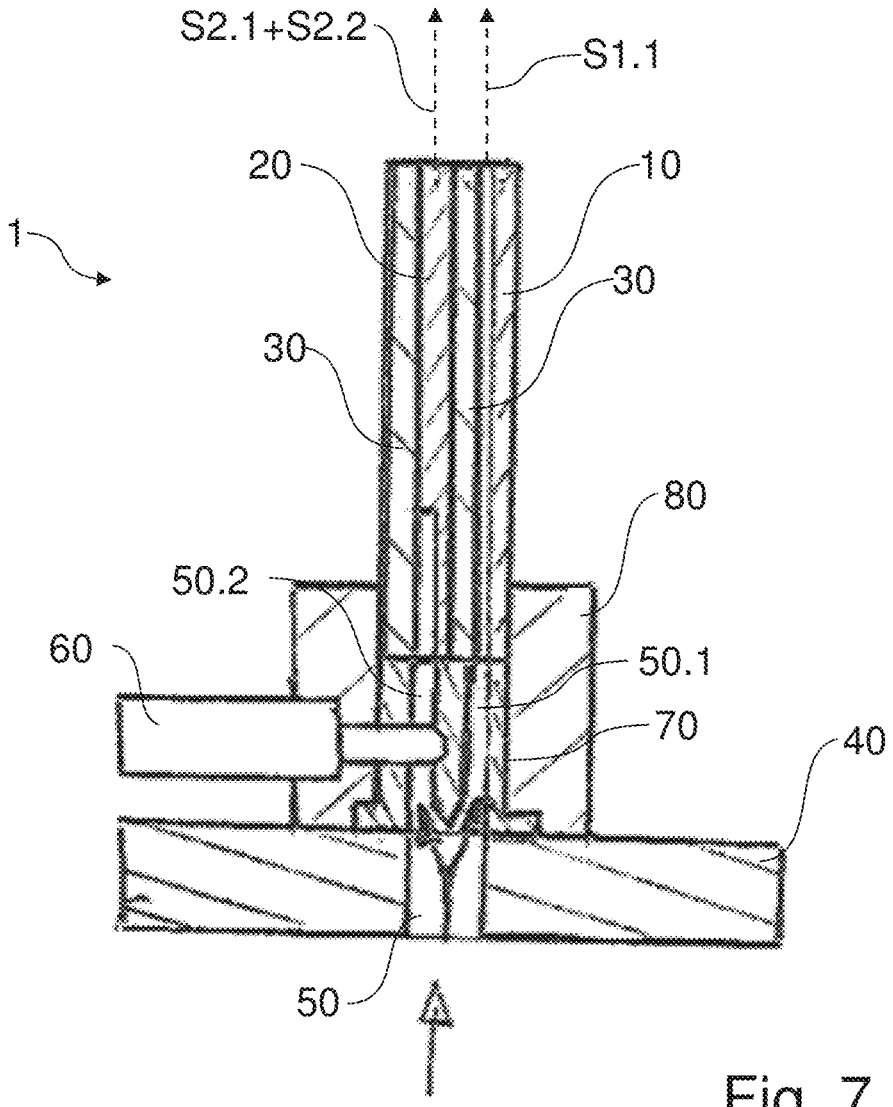
FIG. 7 shows a sectional view of a nozzle device according to another example of the disclosure.
Figure 8:
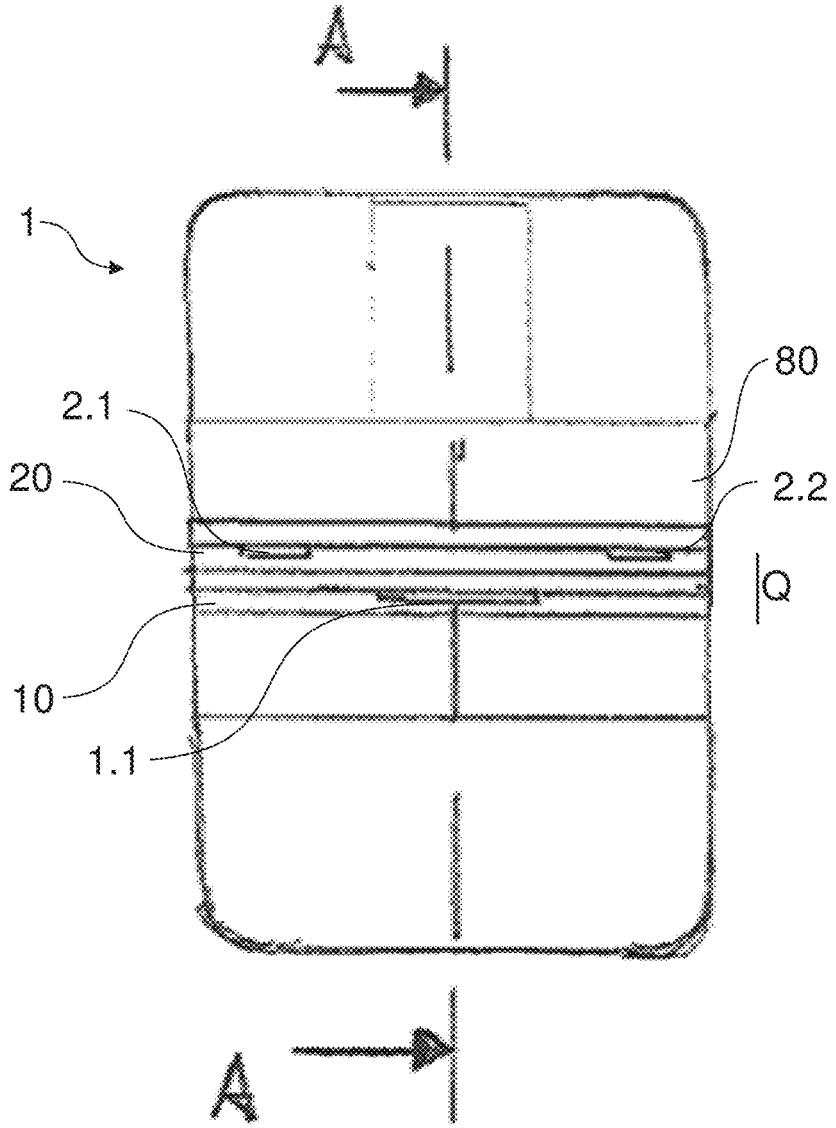
FIG. 8 shows a plan view of the nozzle device of FIG. 7.

FIG. 7 shows a sectional view, along the line A-A of FIG. 8, of a nozzle device 1 according to another example of the disclosure, wherein FIG. 8 shows an associated plan view of the nozzle device 1.

The nozzle device 1 will now be described making reference to FIGS. 7 and 8.

The nozzle device 1 of FIGS. 7 and 8 corresponds in many parts to the example shown in FIG. 6.

A peculiarity, however, is that although the bottom component 70 comprises the first feed portion 50.1 and the second feed portion 50.2, the feed channel 50, via which the emission medium is feedable to the first nozzle plate 10 and to the second nozzle plate 20, ends upstream or substantially at the input side of the holder component 70.

The valve 60 projects exclusively into the second feed portion 50.2 and not into the first feed portion 50.1.

The two openings 2.1, 2.2 of the second nozzle plate 20 are oriented in the same plane. The opening 1.1 of the first nozzle plate 10 is arranged offset, in the transverse direction Q of the first nozzle plate 10 and of the second nozzle plate 20, to the openings 2.1, 2.2 of the second nozzle plate 20.

The opening 1.1 on the one hand and the openings 2.1, 2.2 on the other are oriented substantially parallel so that the emission jet S1.1 is oriented substantially parallel to the emission jets S2.1, S2.2.

Figure 9:
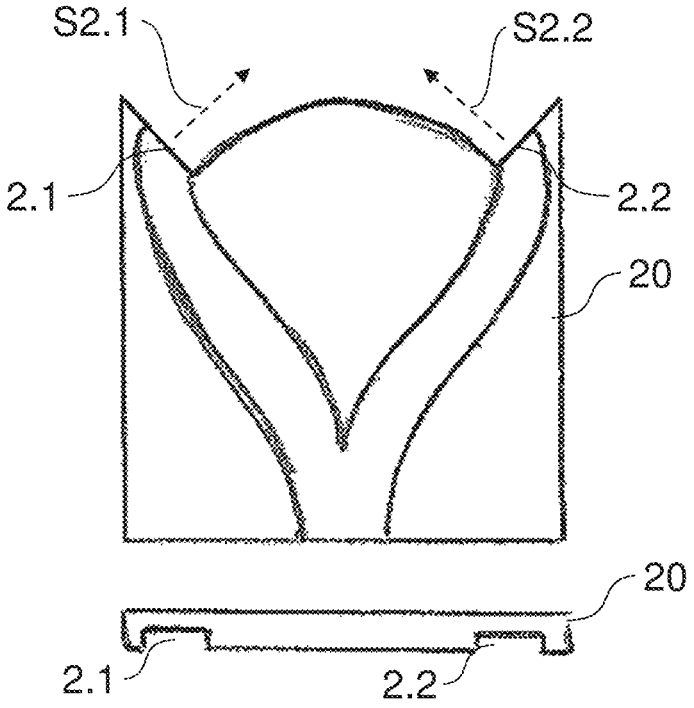
FIG. 9 shows a side view and an associated plan view of a nozzle plate according to another example of the disclosure.

FIG. 9 shows a side view and an associated plan view of a nozzle plate 20 according to another example of the disclosure.

In this example also, the two openings 2.1, 2.2 of the second nozzle plate 20 are oriented inwardly so that the two emission jets S2.1, S2.2 of the second nozzle plate 20 converge to one another toward the emission side A.

Figure 10:
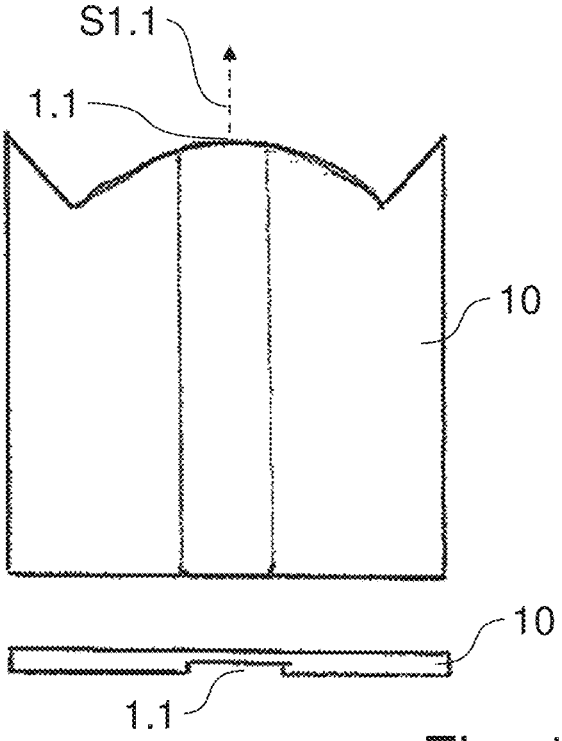
FIG. 10 shows a side view and an associated plan view of a nozzle plate according to another example of the disclosure.

FIG. 10 shows a side view and an associated plan view of a nozzle plate 10 according to another example of the disclosure.

Figure 14:
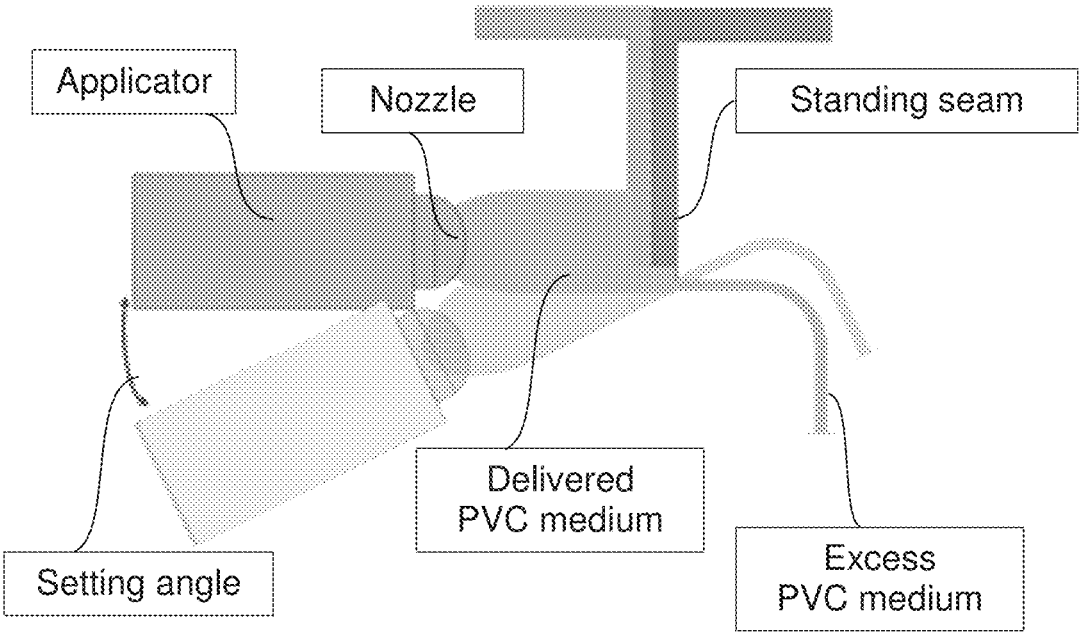
Prior Art Fig. 14
FIG. 14 shows an application process for sealing a standing seam according to the prior art.

In this example, the opening configuration is designed convex to form the opening 1.1. The opening 1.1 is configured as a slit opening in order to emit a flat jet S1.1, the jet width of which, however, expands toward the emission side A, similarly to that shown in FIG. 14.

Figure 11:
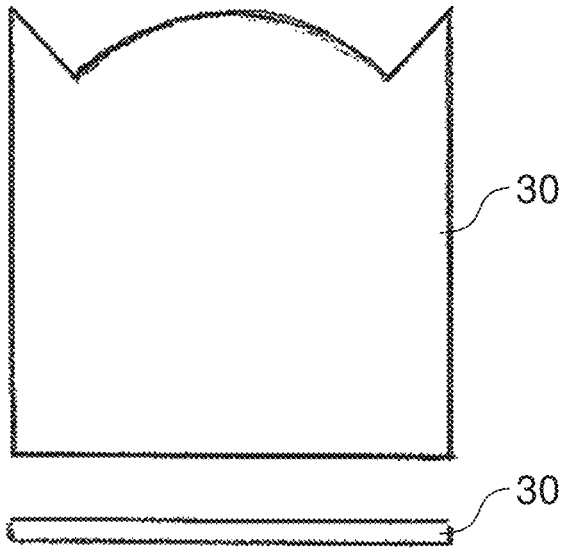
FIG. 11 shows a side view and an associated plan view of a nozzle plate according to another example of the disclosure.

FIG. 11 shows a side view and an associated plan view of a nozzle plate 30 according to one example of the disclosure.

It is possible that the nozzle plates 10, 20, 30 shown in FIGS. 7 and 8 correspond to the nozzle plates 10, 20, 30 of FIGS. 9 to 11.

Thus, a third nozzle plate 30 can be used to close the openings 2.1, 2.2 and the material feed M2 incorporated into the second nozzle plate 20 for the emission medium, in the peripheral direction. Another third nozzle plate 30 can be used to close the opening 1.1 and the material feed M1 incorporated into the first nozzle plate 10 for the emission medium, in the peripheral direction. On the output side, the nozzle plates 10, 20, 30 are configured substantially complementary.

Figure 12:
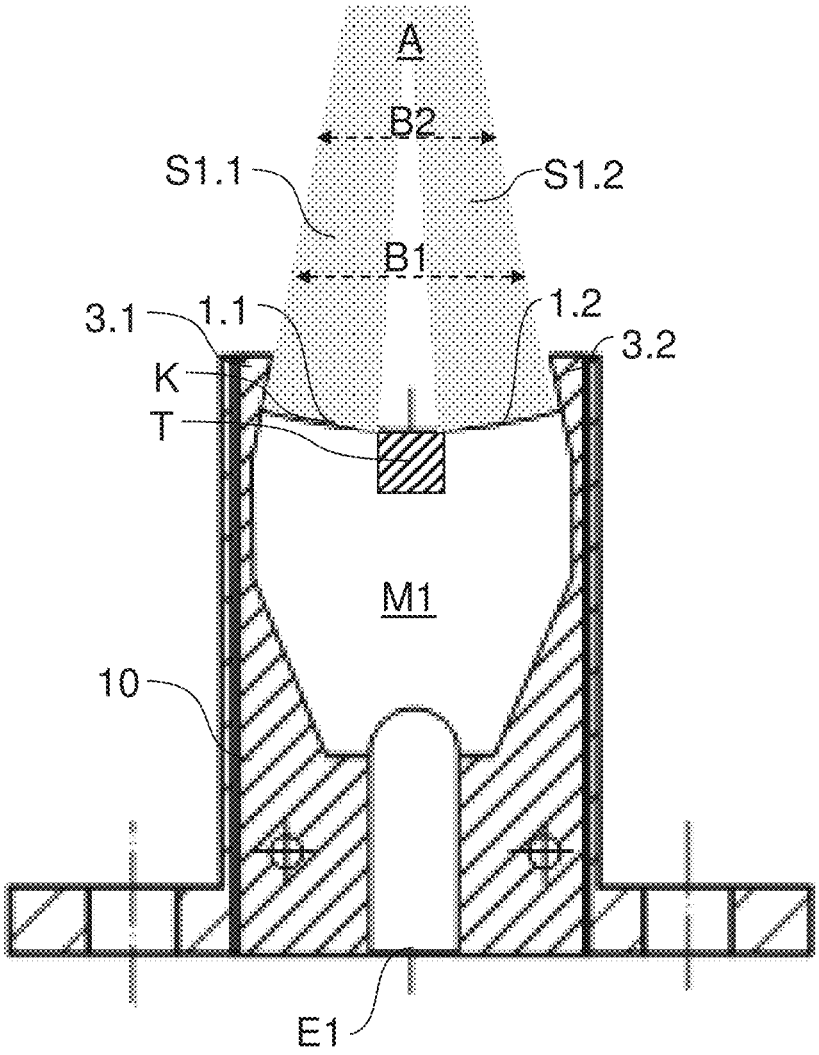
FIG. 12 shows a sectional view of a nozzle plate according to another example of the disclosure.

FIG. 12 shows a sectional view of a, preferably first, nozzle plate 10 according to one example of the disclosure.

The nozzle plate 10 comprises an opening configuration K for forming two openings 1.1, 1.2 configured as slit openings 1.1, 1.2. The openings 1.1, 1.2 serve for the output of two emission jets S1.1, S1.2 configured as flat jets. The opening configuration K is suitably formed concavely bent and preferably comprises a dividing portion T for forming (suitably separating) the two openings 1.1, 1.2.

The two jets S1.1, S1.2 define a jet width B1, B2 encompassing the two jets S1.1, S1.2. In that the opening configuration K is preferably formed concavely bent, a narrowing of the jet width B1, B2 encompassing the two jets S1.1, S1.2 toward the emission side A is brought about. The horn structure 3.1, 3.2 is optional. The two openings 1.1, 1.2 are also oriented inwardly, so that the two emission jets S1.1, S1.2 converge to one another toward the emission side A.

The nozzle plate shown in FIG. 12 can advantageously also be used as a second nozzle plate, since it comprises two openings for the emission of two emission jets and the two openings are preferably oriented inwardly, so that the two emission jets converge to one another toward the emission side.

Figure 13:
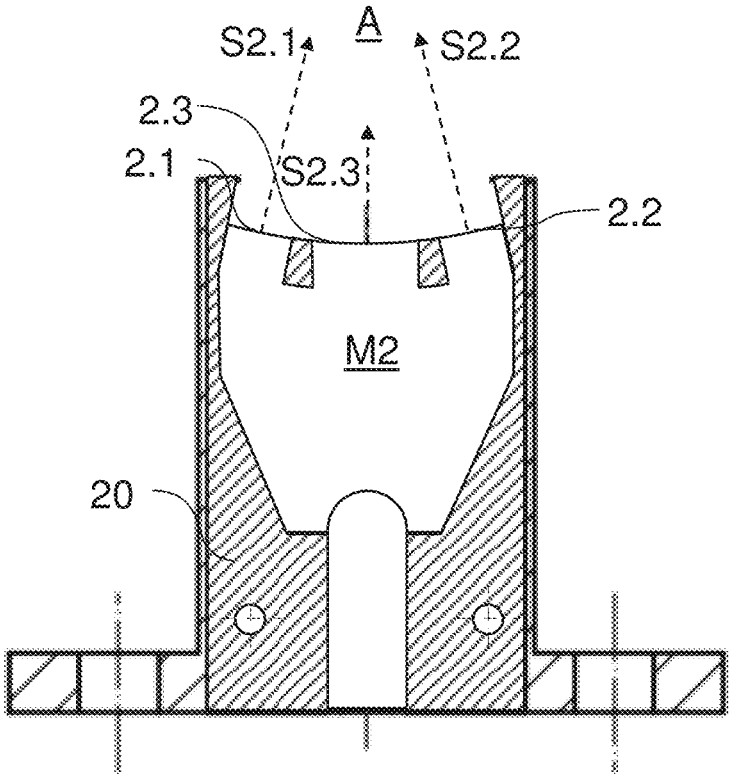
FIG. 13 shows a sectional view of a nozzle plate according to another example of the disclosure.

FIG. 13 shows a sectional view of a second nozzle plate 20 according to another example of the disclosure.

The nozzle plate 20 of FIG. 13 is configured similarly to the nozzle plate 10 of FIG. 12.

A peculiarity, however, is that the nozzle plate 20 comprises three openings 2.1, 2.2, 2.3 for the emission of three emission jets S2.1, S2.2, S2.3.

In the context of the disclosure, it is possible suitably to configure the first nozzle plate like the second nozzle plate or vice versa, so that the disclosure herein relating to the second nozzle plate suitably also applies to the first nozzle plate or vice versa.

The disclosure is not restricted to the above described examples. Rather a plurality of variants and derivations are possible which also make use of the inventive concepts and therefore also fall within the protective scope.

REFERENCE SIGNS

1 Nozzle device
1.1 Opening, preferably slit opening
1.2 Opening, preferably slit opening
2.1 Opening, preferably slit opening
2.2 Opening, preferably slit opening
2.3 Opening, preferably slit opening
3.1 Horn structure
3.2 Horn structure
4.1 Inner flank
4.2 Inner flank
10 Nozzle plate
20 Nozzle plate
30 Nozzle plate
40 Application head, e.g. 3-D gun or 3-D application head
50 Material feed
50.1 Feed portion
50.2 Feed portion
60 Valve, preferably needle valve
70 Bottom component (base component)
80 Plate holder
S1.1 Emission jet, preferably flat jet
S1.2 Emission jet, preferably flat jet
S2.1 Emission jet, preferably flat jet
S2.2 Emission jet, preferably flat jet
S2.3 Emission jet, preferably flat jet
E1 Entry opening
E2 Entry opening
K Opening configuration
B1 Jet width
B2 Jet width
M1 Material feed
M2 Material feed
Q Transverse direction
T Dividing portion
100 Component, preferably motor vehicle component
101 Side surface
102 Side surface
103 End surface

The invention claimed is:

1. A nozzle device for emitting at least one emission medium onto a component, characterised in that the nozzle device comprises:

at least two nozzle plates arranged adjoining one another, the at least two nozzle plates including a first nozzle plate having at least one opening for emitting at least one emission jet and a second nozzle plate having at least two openings for emitting at least two emission jets, the first nozzle plate and the second nozzle plate being thinner at the at least one and the at least two openings than adjacent the at least one and the at least two openings; and wherein the at least one emission jet from the first nozzle plate defines a jet width and the first nozzle plate comprises an opening configuration for the at least one opening, the opening configuration formed concave.

2. The nozzle device according to claim 1, characterised in that the at least two openings of the second nozzle plate are oriented inwardly so that the at least two emission jets of the second nozzle plate converge to one another.

3. The nozzle device according to claim 1, characterised in that the first nozzle plate comprises an entry opening and the second nozzle plate comprises an entry opening and the entry opening of the first nozzle plate and the entry opening of the second nozzle plate are spatially separated from one another.

4. The nozzle device according to claim 3, characterised in that the nozzle device comprises a feed channel for the at least one emission medium, by means of which the at least one emission medium is feedable to the at least one opening of the first nozzle plate and to the at least two openings of the second nozzle plate, so that the at least one opening of the first nozzle plate and the at least two openings of the second nozzle plate are bringable into fluidic connection with the same feed channel.

5. The nozzle device according to claim 4, characterised in that the nozzle device comprises at least one valve, and the valve is configured for optional activation or deactivation of an emission of an emission medium from the at least one opening of the first nozzle plate and/or an emission of an emission medium from the at least two openings of the second nozzle plate.

6. The nozzle device according to claim 5, characterised in that the nozzle device comprises a bottom component which serves as a base for the at least two nozzle plates and arranged in the bottom component is a first feed portion for feeding the emission medium to the at least one opening of the first nozzle plate and a second feed portion for feeding the emission medium to the at least two openings of the second nozzle plate.

7. The nozzle device according to claim 6, characterised in that the first feed portion and the second feed portion are suppliable with emission medium through the feed channel.

8. The nozzle device according to claim 6, characterised in that the valve is configured for the optional opening or closing of the second feed portion and not the first feed portion.

9. The nozzle device according to claim 6, characterised in that the valve is accommodated at least in sections in the bottom component.

10. The nozzle device according to claim 6, characterised in that the nozzle device comprises a plate holder for holding the at least two nozzle plates, the plate holder receiving the bottom component.

11. The nozzle device according to claim 10, characterised in that the valve is accommodated at least in sections in the plate holder.

12. The nozzle device according to claim 1, characterised in that the at least one opening of the first nozzle plate is configured as a slit opening for emitting a flat jet and/or the at least two openings of the second nozzle plate are configured as slit openings for the emission of at least two flat jets.

13. The nozzle device according to claim 12, characterised in that the at least two openings of the second nozzle plate are oriented in a same plane or are oriented at least parallel to one another.

14. The nozzle device according to claim 1, characterised in that the at least one opening of the first nozzle plate and the at least two openings of the second nozzle plate are arranged offset in a transverse direction of the first nozzle plate and of the second nozzle plate, but are oriented in substantially parallel planes.

15. The nozzle device according to claim 1, characterised in that the first nozzle plate comprises a horn structure protruding away from the at least one opening of the first nozzle plate on two sides with two inwardly formed inner flanks in order to deflect inwardly the emission medium issued from the at least one opening of the first nozzle plate.

16. The nozzle device according to claim 1, characterised in that the nozzle device comprises at least one third nozzle plate, the third nozzle plate serves to close the at least one opening of the first nozzle plate with the first nozzle plate closing the at least one opening of the first nozzle plate opposite the third nozzle plate in a peripheral direction or the at least two openings of the second nozzle plate with the second nozzle plate closing the at least two openings of the second nozzle plate opposite the third nozzle plate in the peripheral direction.

17. The nozzle device according to claim 1, characterised in that the first nozzle plate serves to close the at least two openings of the second nozzle plate in a peripheral direction with the second nozzle plate closing the at least two openings of the second nozzle plate opposite the first nozzle plate or the second nozzle plate serves to close the at least one opening of the first nozzle plate in the peripheral direction with the first nozzle plate closing the at least one opening of the first nozzle plate opposite the second nozzle plate.

18. The nozzle device according to claim 1, characterised in that at least two of the following nozzle plates are configured on an output side complementary to one another at least in sections:

the first nozzle plate,
the second nozzle plate,
a third nozzle plate.

* * * * *